US011358408B2

(12) United States Patent
Rowe et al.

(10) Patent No.: US 11,358,408 B2
(45) Date of Patent: Jun. 14, 2022

(54) FILER WITH INSERTABLE COVER

(71) Applicant: ACCO Brands Corporation, Lake Zurich, IL (US)

(72) Inventors: Michael D. Rowe, Medway, OH (US); Elizabeth M. Lacher, Beavercreek, OH (US)

(73) Assignee: ACCO Brands Corporation, Lake Zurich, IL (US)

( * ) Notice: Subject to any disclaimer, the term of this patent is extended or adjusted under 35 U.S.C. 154(b) by 0 days.

(21) Appl. No.: 16/889,080

(22) Filed: Jun. 1, 2020

(65) Prior Publication Data

US 2020/0361231 A1 Nov. 19, 2020

Related U.S. Application Data

(63) Continuation of application No. 13/386,752, filed as application No. PCT/US2011/047023 on Aug. 9, 2011, now abandoned.

(60) Provisional application No. 61/374,682, filed on Aug. 18, 2010.

(51) Int. Cl.

| | |
|---|---|
| ***A45C 11/18*** | (2006.01) |
| ***B43K 23/00*** | (2006.01) |
| ***A45C 13/02*** | (2006.01) |
| ***B42F 7/08*** | (2006.01) |
| ***B42F 21/04*** | (2006.01) |

(52) U.S. Cl.

CPC ..... *B43K 23/001* (2013.01); *A45C 11/18* (2013.01); *A45C 13/02* (2013.01); *B42F 7/08* (2013.01); *B42F 21/04* (2013.01); *B42P 2241/02* (2013.01); *B42P 2241/18* (2013.01)

(58) Field of Classification Search

CPC ..... A45C 11/18; A45C 13/02; B42F 21/04; B42P 2241/02

USPC ..... 229/67.3

See application file for complete search history.

(56) References Cited

U.S. PATENT DOCUMENTS

| | | | |
|---|---|---|---|
| 2,333,798 | A | 11/1943 | Kner |
| 2,385,576 | A | 9/1945 | Isaac |
| 3,073,508 | A | 1/1963 | Walter |
| 4,262,838 | A | 4/1981 | Mackenzie |
| 4,790,474 | A | 12/1988 | Mitsuyama |
| 4,958,728 | A | 9/1990 | Effendi |
| 5,170,889 | A | 12/1992 | Cue |
| 5,271,502 | A | 12/1993 | Chang |
| 6,033,115 | A | 3/2000 | Zeiler |
| 6,607,122 | B1 | 8/2003 | Ong |
| 6,612,771 | B1 | 9/2003 | Su |
| 6,669,080 | B2 | 12/2003 | Ong |

(Continued)

OTHER PUBLICATIONS

CA, Office Action, Canadian Application No. 2,807,795, dated Mar. 18, 2015.

(Continued)

*Primary Examiner* — Peter N Helvey

(74) *Attorney, Agent, or Firm* — Fitch, Even, Tabin & Flannery LLP

(57) ABSTRACT

A filer is disclosed which has front panel and rear panel defining a storage compartment therebetween, the storage compartment having a width. The filer includes a cover coupled to the rear panel and releasably attachable to the front panel to generally cover or seal the storage compartment. A distal portion of the cover has a width that is about equal to or smaller than the width of the storage compartment to allow the distal portion of the front cover to be received in the storage compartment.

19 Claims, 10 Drawing Sheets

(56) References Cited

U.S. PATENT DOCUMENTS

| | | | |
|---|---|---|---|
| 6,758,336 | B2 | 7/2004 | Kohana |
| 6,796,428 | B1 | 9/2004 | Ong |
| 6,837,368 | B1 | 1/2005 | Chang |
| 6,905,064 | B1 | 6/2005 | Ong |
| 6,968,949 | B2 | 11/2005 | Zivic |
| 7,237,710 | B1 | 7/2007 | Ong |
| 7,458,501 | B1 | 12/2008 | Pelleg |
| 7,644,857 | B2 | 1/2010 | Chou |
| D613,158 | S | 4/2010 | Russell |
| D618,096 | S | 6/2010 | Eadicicco |
| 2003/0183679 | A1 | 10/2003 | Ong |
| 2003/0234281 | A1 | 12/2003 | Ho |
| 2007/0125835 | A1 | 6/2007 | Pelleg |
| 2007/0194090 | A1 | 8/2007 | Chou |
| 2007/0235506 | A1 | 10/2007 | Shapiro |
| 2008/0041924 | A1 | 2/2008 | Christensen |

OTHER PUBLICATIONS

International Search Report and International Preliminary Report for: Rowe, Michael D. et al. "Filer with Insertable Cover," International Application No. PCT/US11/47023, filed Aug. 9, 2011.

FILER WITH INSERTABLE COVER

REFERENCE TO RELATED APPLICATIONS

This application is a continuation of U.S. patent application Ser. No. 13/386,752, filed on Jan. 24, 2012, which is a U.S. national phase application filed under 35 U.S.C. § 371 of International Application No. PCT/US2011/047023, filed on Aug. 9, 2011, designating the United States, which claims the benefit of priority under 35 U.S.C. § 119(e) of U.S. provisional application Ser. No. 61/374,682, filed on Aug. 18, 2010, all of which are hereby incorporated by reference in their entirety.

The present invention is directed to a filer for storing loose papers and the like, and more particularly, to a filer having a cover that is insertable into the filer.

BACKGROUND

Filers, such as accordion-style folders and the like, are used by students, professionals and others for storing loose-leaf papers and the like. Such filers may be utilized as portable devices to carry papers in a convenient and organized manner. Many filers include a cover which closes the filer and must be moved out of the way to access the contents of the filer. However, many existing filers do not provide satisfactory positioning of the cover when it is opened.

SUMMARY

In one embodiment, the invention is a filer including a front panel and rear panel defining a storage compartment therebetween, the storage compartment having a width. The filer further includes a cover coupled to the rear panel and releasably attachable to the front panel to generally cover or seal the storage compartment. A distal portion of the cover has a width that is about equal to or smaller than the width of the storage compartment to allow the distal portion of the front cover to be received in the storage compartment.

DETAILED DESCRIPTION

Figure 1:
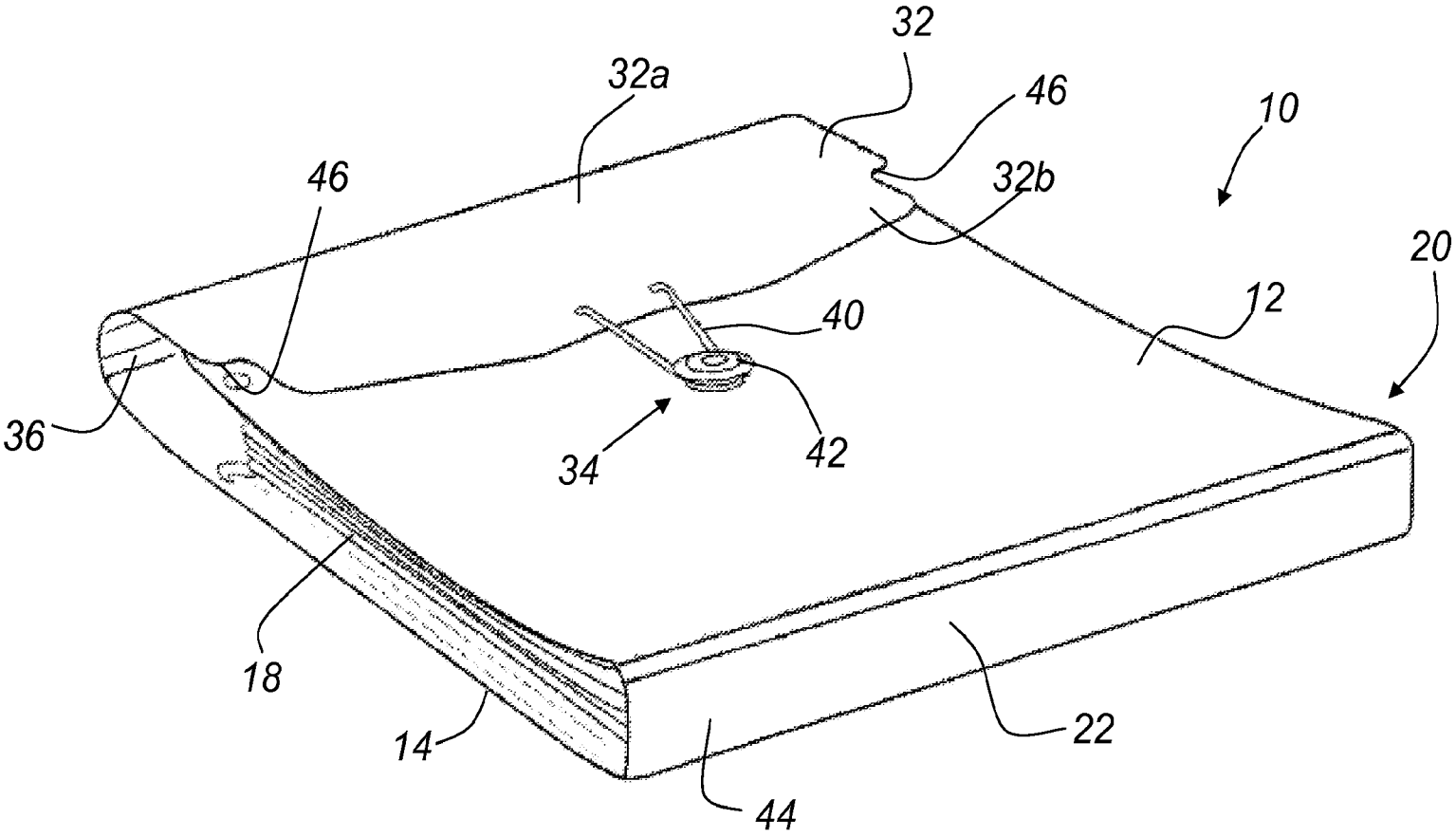
FIG. 1 is a front perspective view of one embodiment of the filer of the present invention, shown in its closed position.
Figure 2:
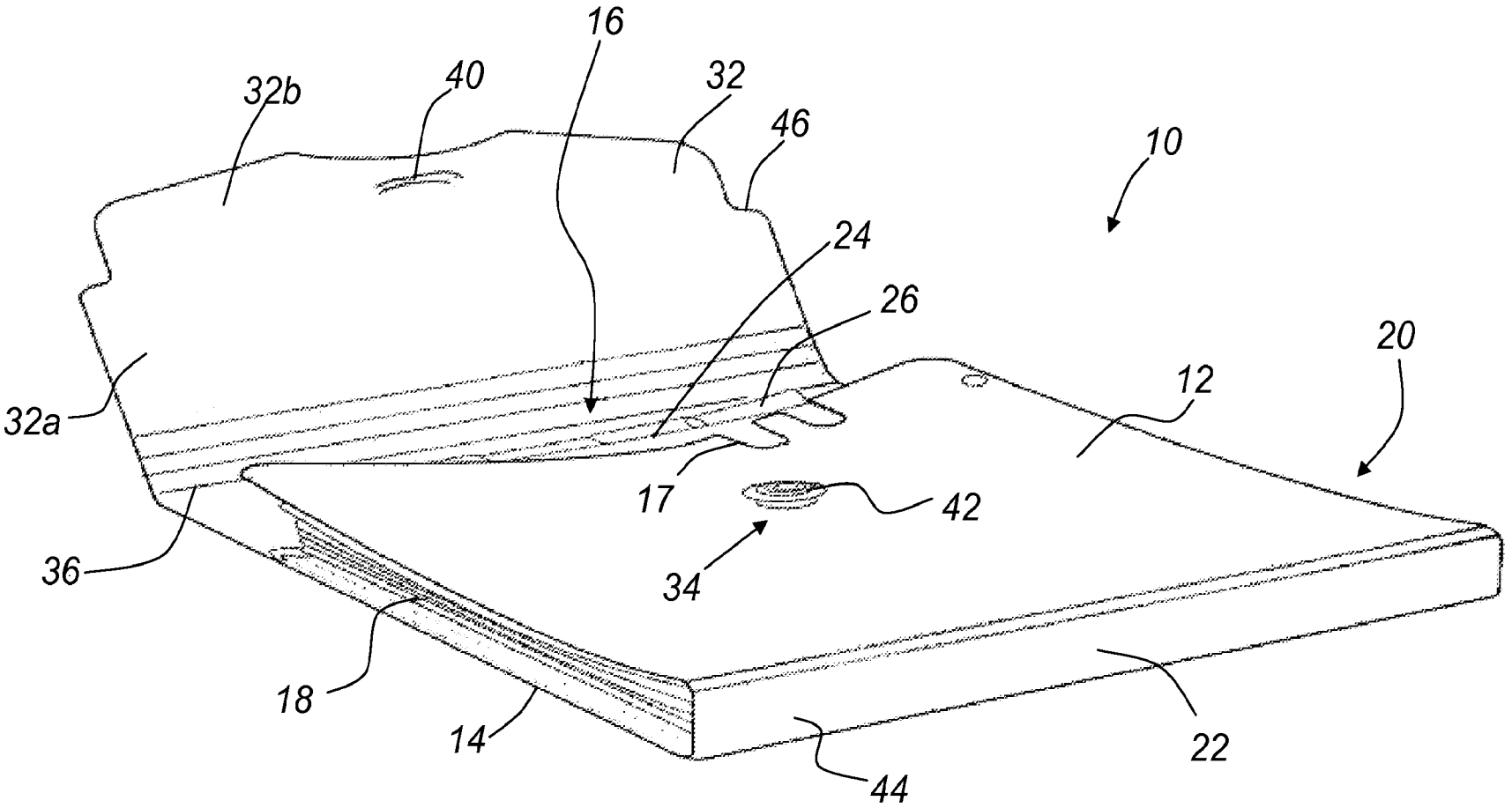
FIG. 2 is a front perspective view of the filer of FIG. 1, with the cover opened.

As shown in FIGS. 1-12, the filer 10 of the present invention may include a front panel 12 and a rear panel 14, with a storage compartment 16 positioned therebetween. The filer 10 may include a pair of opposed side panels 18, 20 and a bottom panel 22 extending between the front panel 12 and rear panel 14. In the illustrated embodiment, each of the side panels 18, 20 may be made of expandable/collapsible accordion-style material. A plurality of generally rectangular folders 24 (or dividers or other content) may be positioned in the storage compartment 16 to define a plurality of pockets or spaces for receiving loose papers and the like. Each folder 24 may have a label tab 26 extending generally upward therefrom, and each folder 24 may be removable from the storage compartment 16. Alternately, each folder 24 may be non-removably received in the storage compartment 16, and/or a plurality of dividers may be positioned in the storage compartment 16. Such dividers may be attached to one or more of panels 18, 20, and 22. While some of the Figures illustrate the filer containing five to six tabbed folders or dividers, it should be understood that any number of folders, dividers, or other content may be contained, with or without tabs, attached within the filer, or removable from the filer. Alternately the filer may be provided without any contents.

Figure 4:
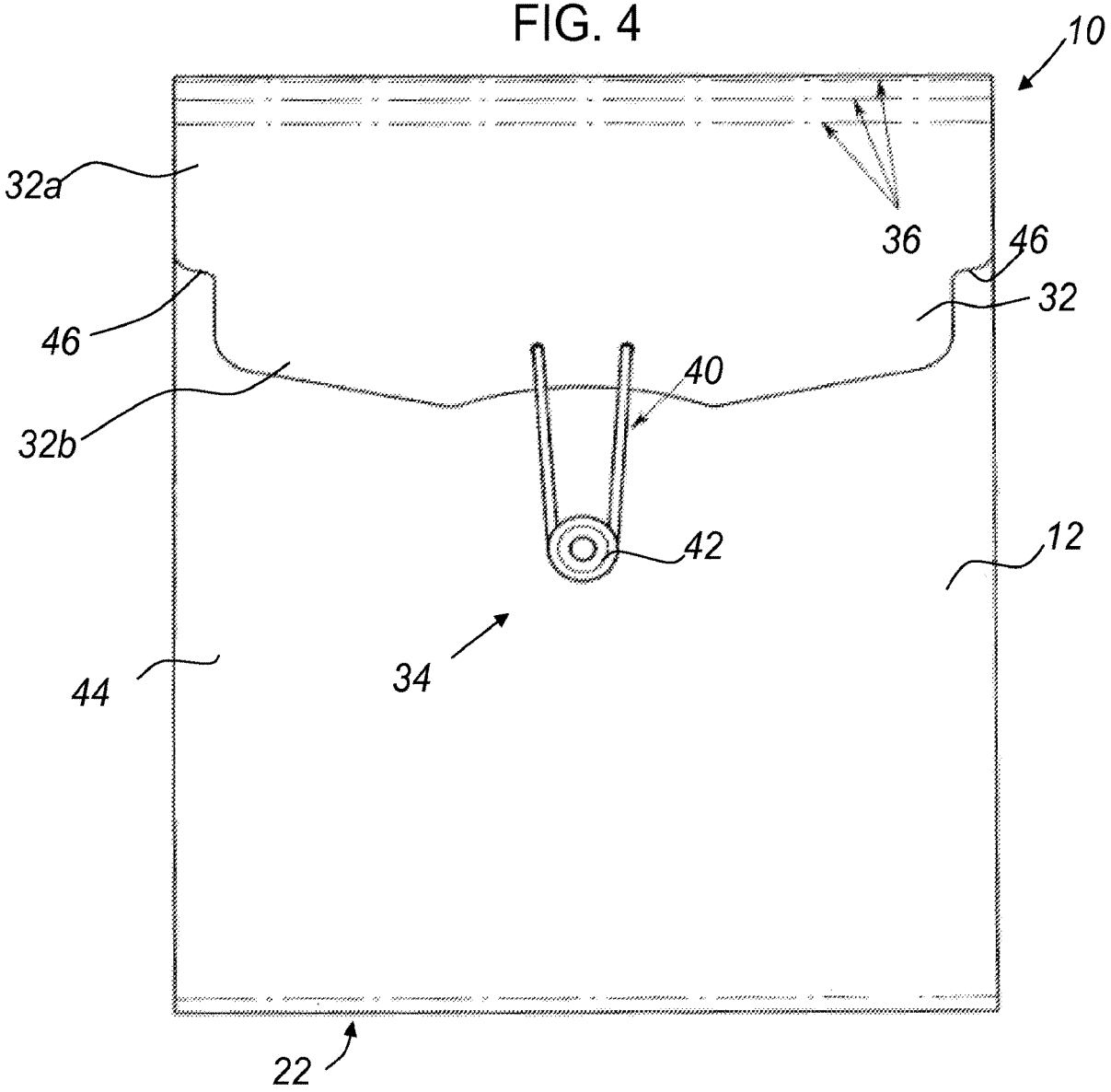
FIG. 4 is a front view of another embodiment of the filer of the present invention, shown in its closed position.
Figure 8:
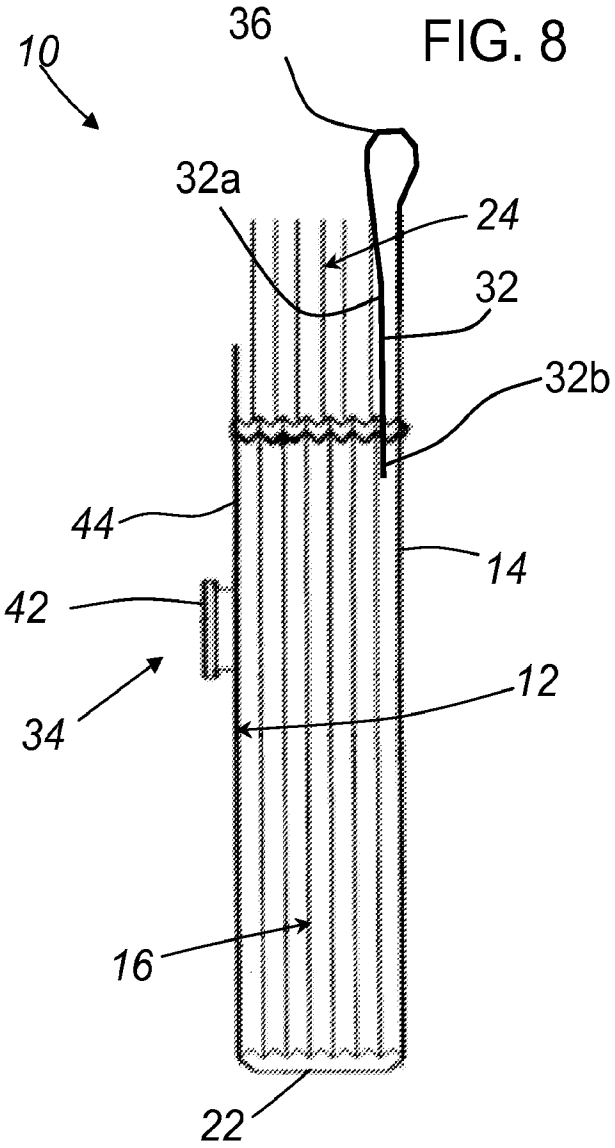
FIG. 8 is a side view of the filer of FIG. 7.
Figure 5:
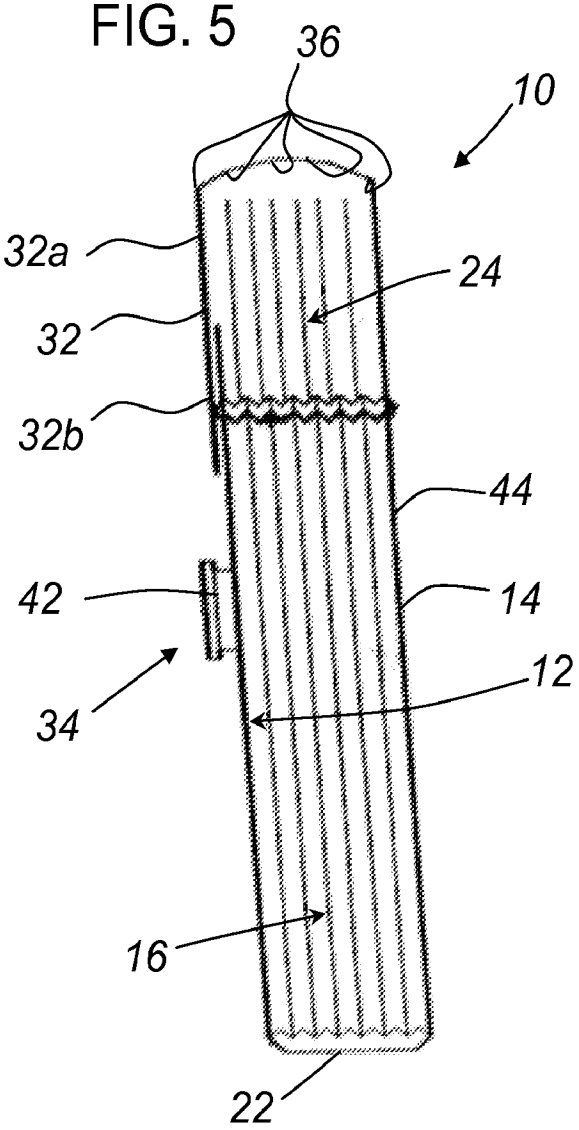
FIG. 5 is a side view of the filer of FIG. 4.

The filer 10 includes a cover 32 fixedly yet flexibly or movably coupled to the rear panel 14, and removably attachable to the front panel 12. The cover 32 is movable between a closed position, as shown in FIGS. 1, 4, 5, 9A, 10A, 10C, 11A and 12A wherein the cover 32 generally covers and/or seals the storage compartment 16 to retain items therein, and an open position (FIGS. 2, 3 6-8, 9B, 10B, 11B and 12B) in which the cover 32 does not generally cover and/or seal the storage compartment 16. When in the closed position, the cover 32 is generally co-planar with, and positioned outside but adjacent to or in contact with, the front panel 12. In the fully open configuration shown in FIGS. 2 and 6, the cover 32 extends generally upwardly from the rear panel 14 and is generally co-planar with the rear panel 14. The cover 32 and/or rear panel 14 may include a flex area such as a plurality of transverse crease lines or areas of weakness 36 formed therein to enable the front cover 32 to move or flex relative to the rear panel 14. The filer 10 may be expandable due to the expandable nature of the accordion-style side panels 18, 20, and the creases 36 in the cover 32 enable the cover 32 to bow and accommodate expansion of the filer 10. Instead of crease lines 36, cover 32 may include a flex area made of a material having more flexibility than the remainder of cover 32 and/or rear panel 14. For example if the cover 32 and/or rear panel 14 are made of a plastic sheet material having a certain thickness, such a flex area may be made of a thinner plastic sheet material, or a fabric material. The crease lines 36 may be formed at least in part by perforating or slitting the cover 32. As shown in FIGS. 5 and 8, the flex area or crease lines 36 may be located generally above the height of any intended contents of the filer, for example, above the height of any folders 24 contained within the filer.

The cover 32, or any part of the filer, may be formed in one or more pieces, and from one or more materials. At least part of the cover 32 or the filer in general may be transparent or provided with an opening, for example to view the contents of the filer.

Figure 11B:
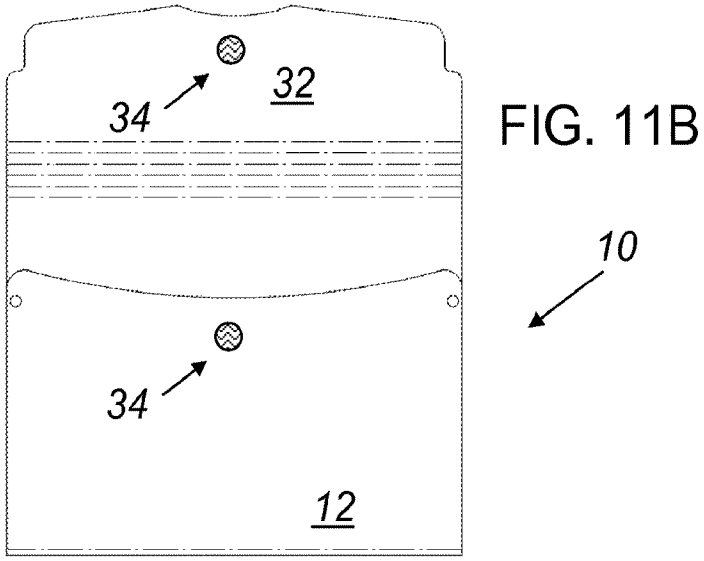
FIGS. 11A-12B are front views of other files in closed and open positions.
Figure 12B:
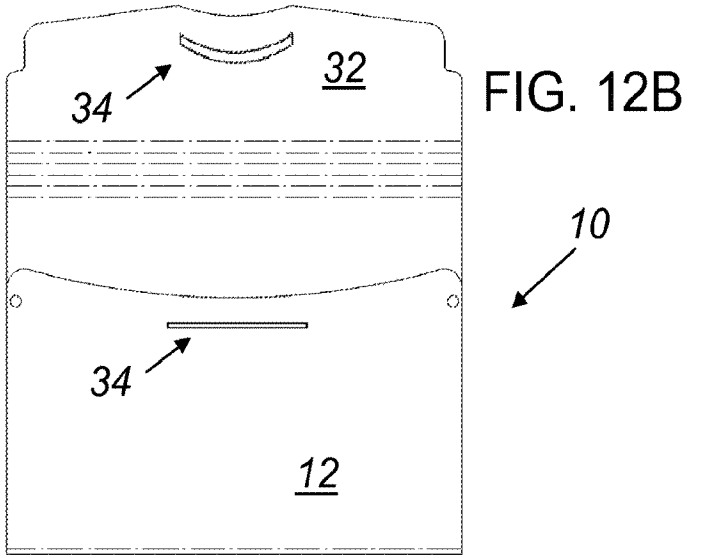
Figure 11A:
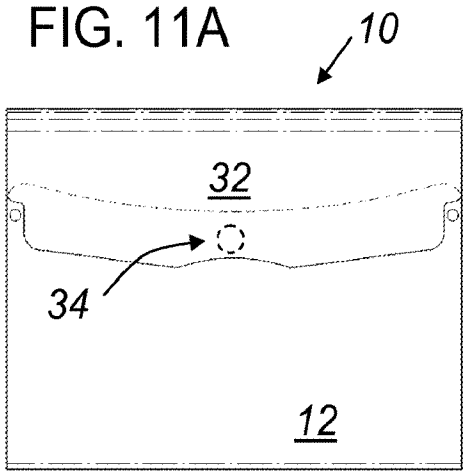
Figure 12A:
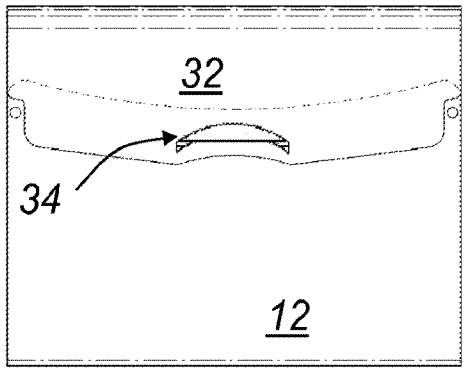

The cover 32 and/or front panel 12 may include an optional retaining means 34 to releasably couple the cover 32 to the front panel 12, and thereby retain the filer 10 in its closed position. In the illustrated embodiment, the retaining means 34 includes a cord, such as an elastic cord 40, coupled to the cover 32, and a rivet 42, button, post or the like located on the front panel 12. As shown in FIGS. 1 and 4, the elastic cord 40 can be stretched and fit around the rivet 42 to retain the cover 32 in place against the front panel 12. However, the retaining means 34 need not include both the cord 40/rivet 42 and may, for example, include only one of the cord 40/rivet 42. Further, the position of the rivet 42 and cord 40 may be reversed such that the rivet 42 is located on the cover 32 and the cord 40 is located on the front panel 12. Additionally, any of a wide variety of mechanisms may be used as the retaining means 34, including but not limited to, hook-and-loop fastening material (such as VELCRO® as illustrated in FIGS. 11A, 11B), clasps, brackets, magnets, interengaging geometries such as illustrated in FIGS. 12A and 12B, cords, ties and the like. Instead of, or in addition to, retaining means 34 being provided to couple the cover 32 and outside of front panel 12 as shown, retaining means may be provided to couple the cover 32 with the inside of the front panel 12, with the inside or outside of the back cover 14, or with content items such as folders or dividers. The retaining means 34 is optional and may be omitted.

Front panel 12 may be provided with one or more optional notches 17 for receiving writing utensils such as pens or pencils which may have a clip that will fit in notch 17.

The front panel 12, rear panel 14, bottom panel 22, and cover 32, may each be made of a material to form an outer casing 44 of the filer 10. The material or materials used may be chosen according to manufacturing preference. In one embodiment, the material may be a relatively durable, stiff and rigid material such as 0.65 mm thick polypropylene or polyethylene. The material may also be paper, paperboard, fabric, or other material. In one embodiment, the front panel 12, rear panel 14, bottom panel 22, and cover 32 arc made from a single piece of material. If desired, however, any one or each of the panels 12, 14, 22, 32 may be made from separate pieces of material. Each of the panels 18, 20 and folders 24 may be made of a material chosen according to manufacturing preference, for example a relatively thin and flexible plastic material such as, for example, 0.5 mm thick plastic film. However, paper, paperboard, fabric, and other material may be used.

Figure 6:
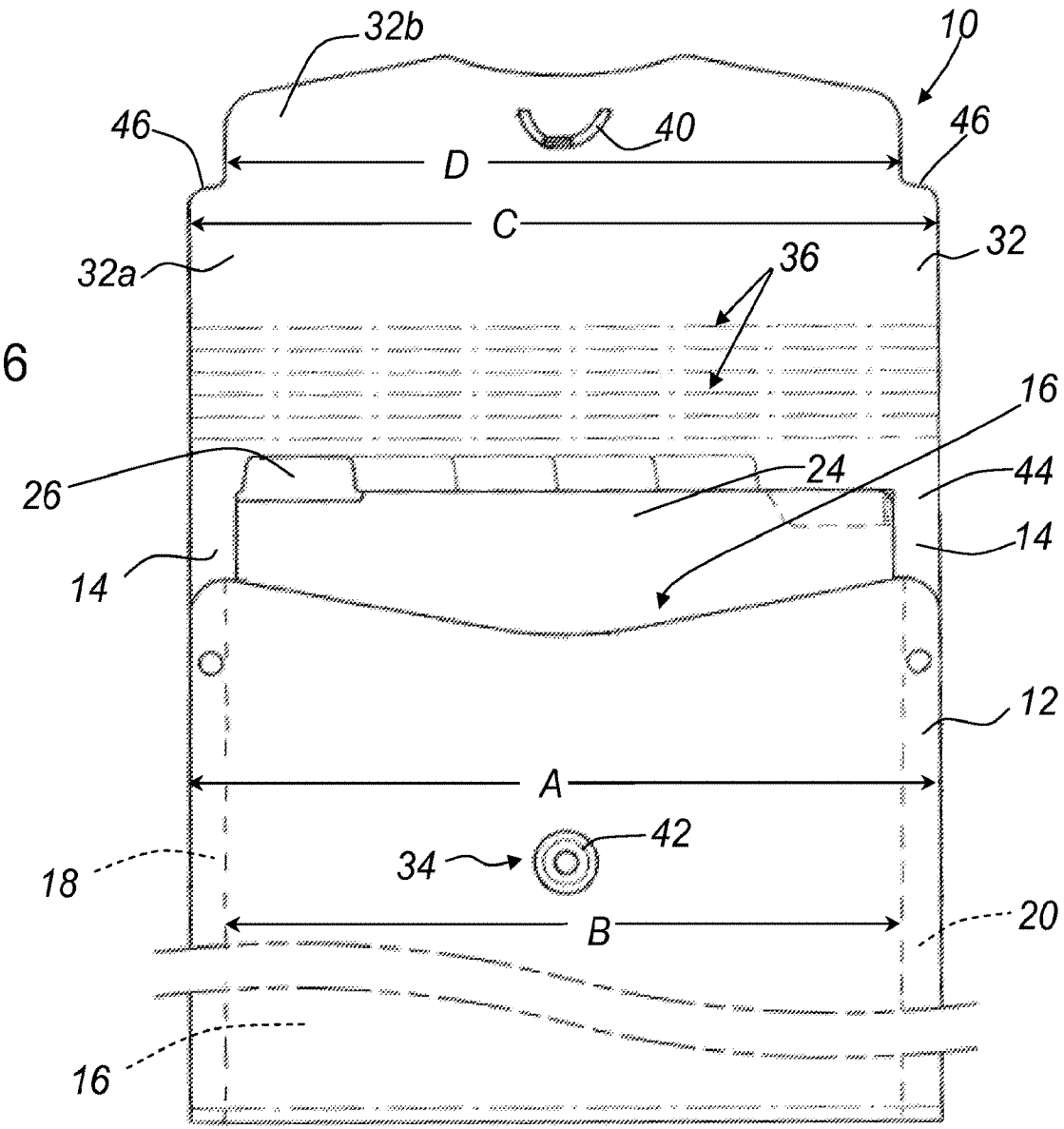
FIG. 6 is a front view of the filer of FIG. 4, with the cover opened.

As best shown in FIG. 6, the front panel 12/rear panel 14/bottom panel 22/outer casing 44 has a width A in a lateral or left-to-right direction. The storage compartment 16 may have a width B in the lateral direction that is somewhat less than the width A. In particular, due to the inward positioning on the side panels 18, 20 and/or the folded/accordion nature of the side panels 18, 20, each side panel 18, 20 may extend inwardly, thereby reducing the effective width of the storage compartment 16, which can be considered the distance between the inner-most portions of the side panels 18, 20.

The cover 32 includes a base or upper or proximal portion 32*a* (nearer rear panel 14) with a first width C, and a second, lower or distal portion 32*b* (further from rear panel 14) with a smaller width D. The width C is, in the illustrated embodiment, about equal to the width A of the front panel 12, rear panel 14, and bottom panel 22. The width D, in the illustrated embodiment, is slightly less than, or about equal to, the width B of the storage compartment 16 (i.e., within about 3% of the width B). However, width D may also be substantially less than width B, or width D may be equal to or somewhat greater than width B. A pair of opposed notches 46 in cover 32 delineate upper portion 32*a* and lower portion 32*b*.

Figure 3:
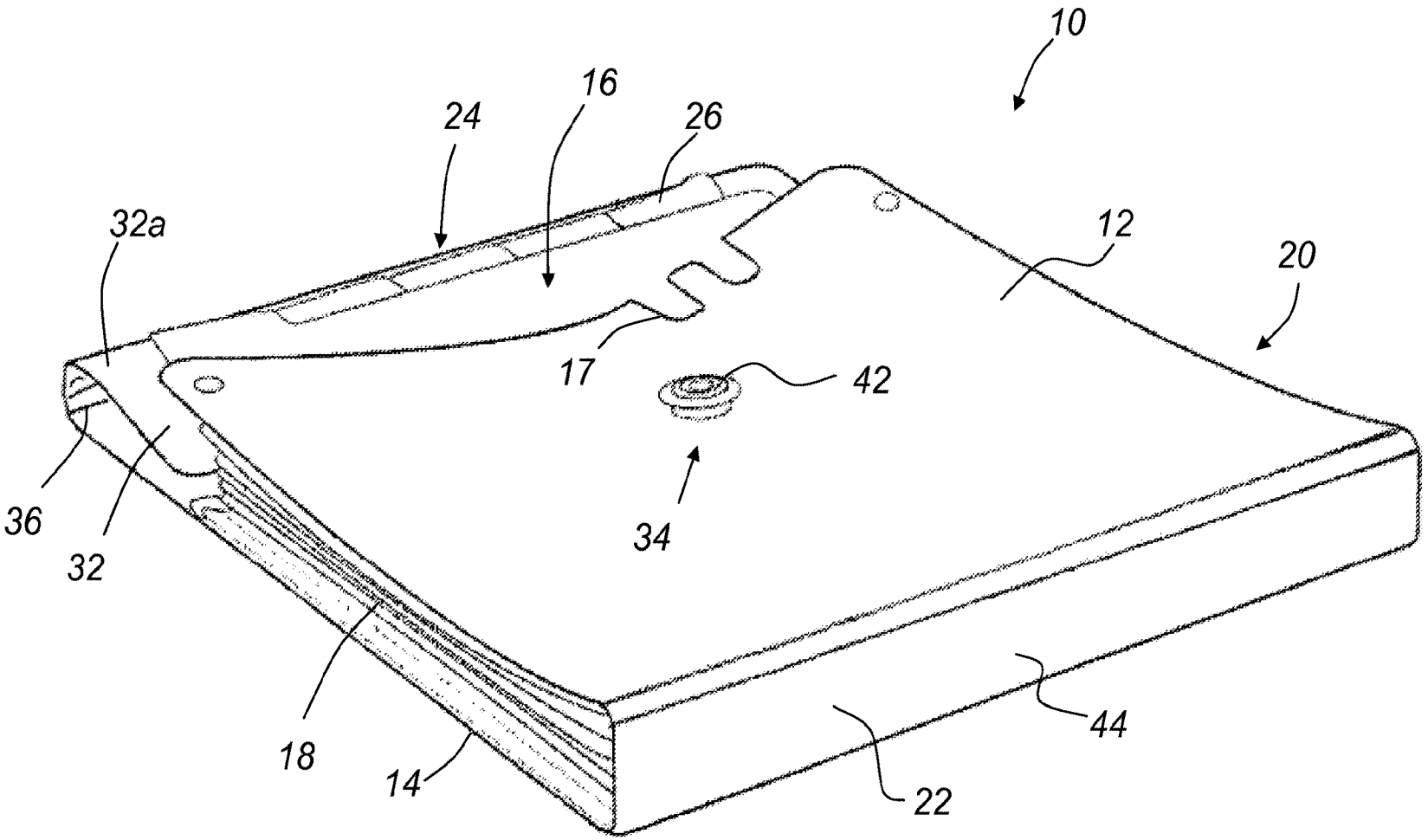
FIG. 3 is a front perspective view of the filer of FIG. 2, with the cover inserted into the storage compartment.
Figure 7:
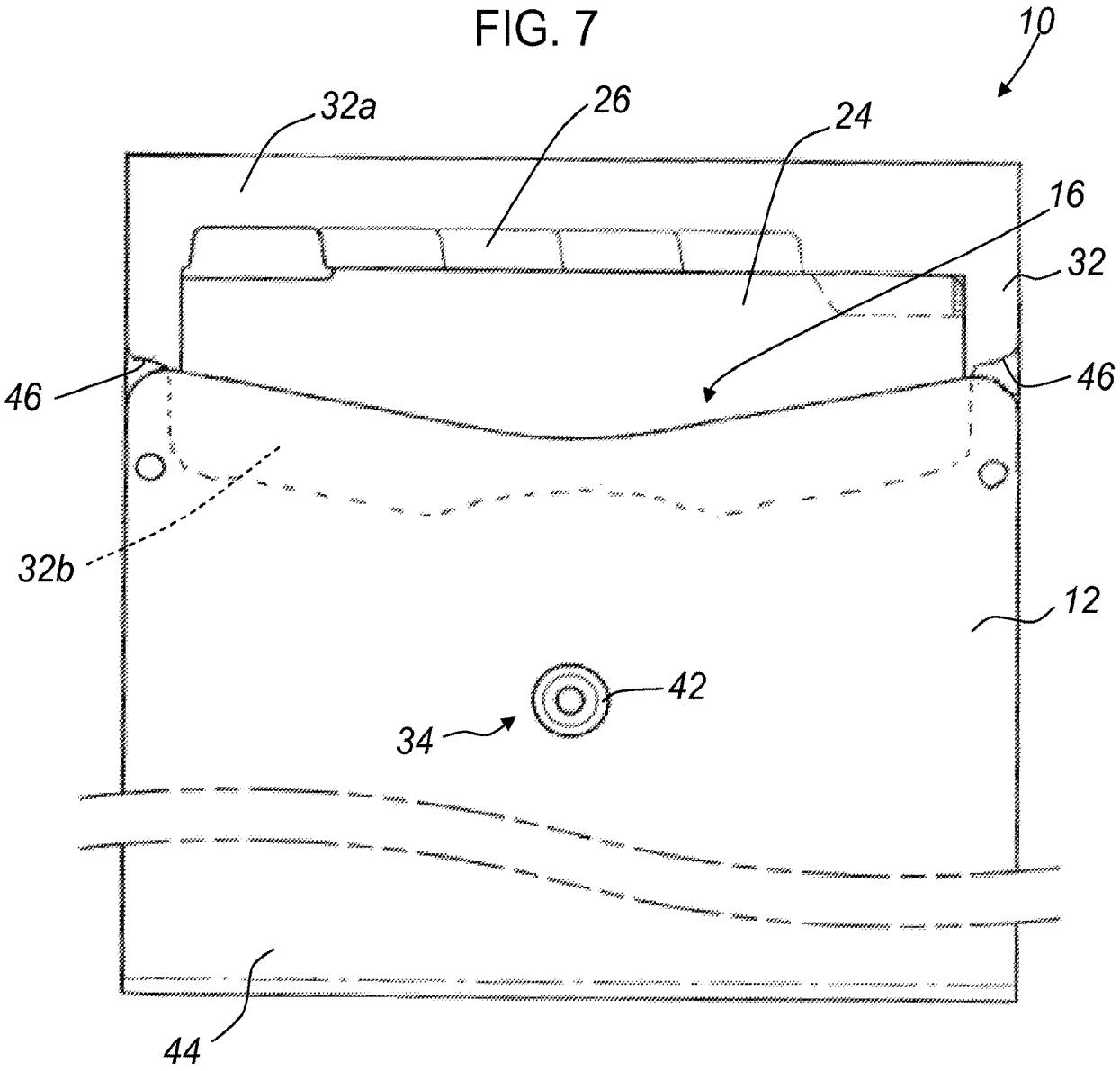
FIG. 7 is a front view of the filer of FIG. 6, with the cover inserted into the storage compartment.

As shown in FIGS. 3, 7 and 8, the reduced width portion 32*b* of the cover 32 enables the cover 32 to be inserted into the storage compartment 16 when the filer 10 is in its open position. In particular, the lower portion 32*b* can be inserted into the storage compartment 16 until the notches 46 engage the side panels 18, 20.

The crease lines 36 may be made to lend sufficient flexibility to the cover 32 such that the cover 32 generally desires to lay flat against the front panel. The crease lines 36 may be made to cause the cover 32 to have an approximately 180 degree curve so that the portions 32*a*, 32*b* tend to lie parallel with panels 12, 14. Accordingly, when the cover 32 is inserted into the storage compartment 16, as shown in FIGS. 3, 7 and 8, the cover 32 remains in place due to the curved shape, or due to frictional engagement of the front cover 32 with other components.

If the width D of the portion 32*b* is made slightly greater than the width B of the storage compartment 16, the portion 32*b* can be inserted with slight resiliency but without significantly deforming, which helps to keep the cover 32 in place. Cover portions 32*a*, 32*b* may be flexed or deformed slightly in order to move cover 32 from the outside of filer 10 to the inside, or vice versa. However, once released in either the outside or inside of filer 10, portions 32*a*, 32*b* may have sufficient stiffness and resilience to assume a flat configuration, and thereby rest easily against the outside of panel 12, or inside the pocket. Crease lines 36 may be formed so as to focus the bending of cover 32 in a limited area so that the bend does not become bulbous or the cover too springy, which might tend either to "open" the cover when it in intended to be closed against panel 12, or to move the cover out of the filer, when the cover is intended to remain inside the filer. By appropriately forming of crease lines 36, the portions 32*a*, 32*b* may be made to tend to lie approximately parallel to panels 12 and/or 14. The crease lines may be linear or nonlinear. One or more crease lines may be provided. The number, width, depth, and spacing of crease lines 36 may be chosen according to manufacturing preference. Instead of, or in addition to, the crease lines, apertures such as slits (not shown) may be used to provide the flex area. In one embodiment, the flex area may cover a front-to-back width approximately equal to the front-to-back width of bottom panel 22. However, the flex area may cover a greater or lesser width than bottom panel 22.

Thus, the insertable nature of the cover 32 enables the user to tuck the cover 32 into the storage compartment 16, which places the cover 32 out of the way and enables full access to the folders 24/storage compartment 16. In this manner, the user can easily place the cover 32 in a position where the cover 32 is not in the way of the user and does not block access. Moreover, the cover 32 is not flipped over/behind the rear panel 14, which merely presents an additional free surface which can be caught on other items, and is not a feasible position for the cover 32 when the filer 10 is positioned flat against another surface (i.e., backed against a wall, or another filer, or stack of documents, etc.).

The filer may be made of any convenient sheet material. By means of example, the filer may be made of sheet plastic, such as polypropylene or polyethylene, or other plastic, having a sheet thickness from about 0.020" to 0.030". However, other thicknesses may also be used, as may other sheet materials, including paper or paperboard (with or without coatings including plastic coatings), or even cloth, leather, or metal.

If desired, additional retaining means (such as magnets, hook-and-loop fasteners, or other fastening means disclosed above in the context of the retaining means 34), can be utilized to retain the cover 32 in the inserted position. However, in other embodiments, the cover 32 is retained in its inserted position either by shape memory, frictional forces, or physical interference with other parts of the filer such as accordion style material in side panels 18, 20. Moreover, it is not necessarily required that the cover 32 have an upper portion 32*a* of a greater width than the lower portion 32*b*. However, in one embodiment, providing the upper portion 32*a* with a greater width helps to more securely cover the storage compartment 16 and retain any loose components therein.

In the embodiment shown in FIGS. 3, 7 and 8, the cover 32 is inserted in the rear-most position of the storage compartment 16 such that the cover 32 is positioned adjacent to the rear panel 14, as best shown in FIG. 8. However, the cover 32 can be inserted at any position along the depth of the storage compartment 16 and can, for example, be used as a placeholder or marker by a user of the filer 10.

Figure 9B:
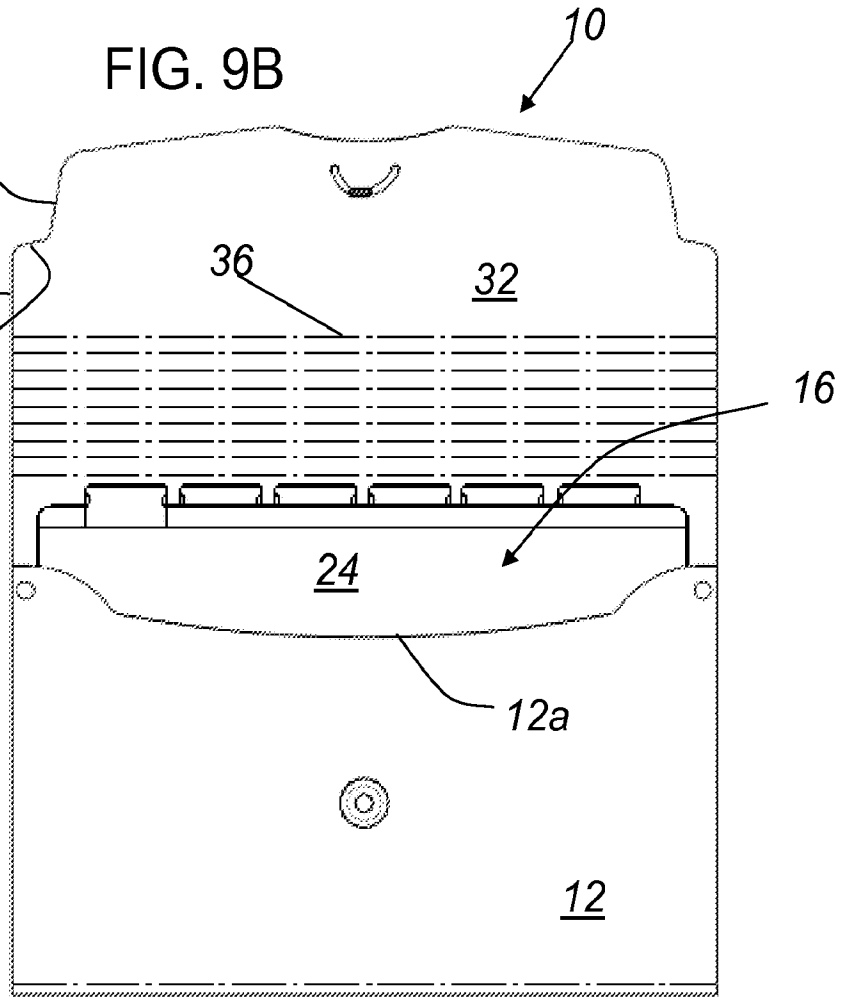
FIGS. 9A and 9B are front views of another filer in closed and open positions.
Figure 9A:
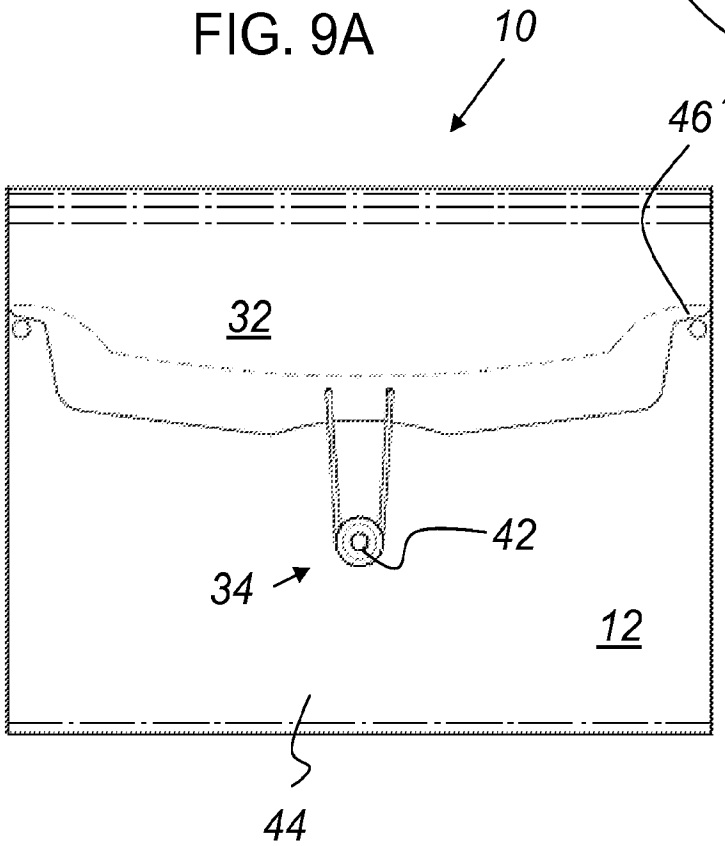
Figures 10A, 10B, 10C:
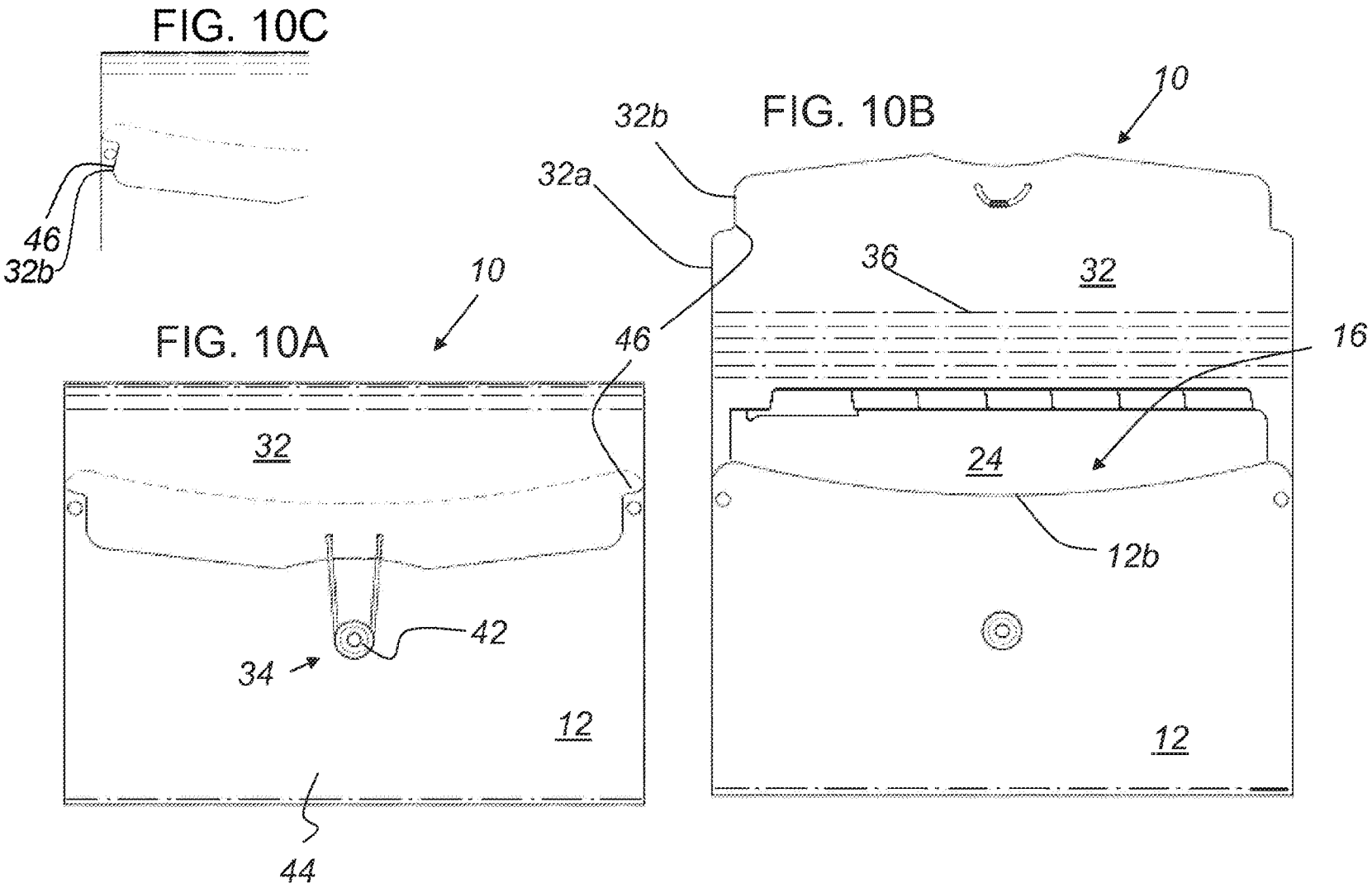
FIGS. 10A-10C are front views of yet other filers in closed and open positions.

FIGS. 4, 6 and 7 depict filers that may receive contents in a "portrait" orientation, and therefore may have a "taller" aspect ratio as would receive sheets with a long or longer dimension running vertically. FIGS. 9-12 show filers that may receive contents in a "landscape" orientation, and may therefore may have a "wider" aspect ratio as would receive sheets with a long or longer dimension running horizontally. The shape of notches 46 may be chosen according to manufacturing preference any filer described here. For example the lower portion 32*b* may have outer edges that are generally parallel to the sides of the filer as shown in FIGS. 10A, 10B. Such a configuration might allow the lower portion 32*b* to fit relatively tightly within pocket 16. However, the lower portion 32*b* may have outer edges that become narrower as they approach end of the lower portion as shown in FIGS. 9A, 9B. Such a configuration might allow the lower portion 32*b* to more easily be inserted into pocket 16. The lower portion 32*b* may have outer edges that become wider as they approach end of the lower portion as shown in FIG. 10C. Depending on how closely the outer edges fits against the inside of the pocket 16, such a configuration might cause the lower portion 32*b* to more readily remain in place once inserted into pocket 16.

Besides the cord and button closure means 34 as shown in FIGS. 1-10, other closure means may be utilized. FIGS. 11A and 11B show closed and open configurations of a filer 10 using one or more closure means 34 that may take the form of hook and loop fasteners, releasable adhesives, magnetic devices, and the like. FIGS. 12A and 12B show closed and open configurations of a filer 10 using one or more inter-engaging features such as cutouts, slits, and the like that fit together to hold the filer in a desired configuration.

Besides use with a filer, the cover described herein may be used with other storage compartments including envelopes, file boxes, and the like.

Having described the invention in detail and by reference to the preferred embodiments, it will be apparent that modifications and variations thereof are possible without departing from the scope of the invention.

In one embodiment, the invention is a filer including a front panel and rear panel defining a storage compartment therebetween, the storage compartment having a width. The filer further includes a cover coupled to the rear panel and releasably attachable to the front panel to generally cover or seal the storage compartment. At least a distal portion of the cover has a width that is about equal to or smaller than the width of the storage compartment to allow the distal portion of the front cover to be received in the storage compartment.

In one embodiment, the width of the storage compartment is less than the width of the front or rear panels.

In one embodiment, the cover has a base portion having a width greater than the distal portion.

In one embodiment, the filer is configured to enable the cover to be received in the storage compartment adjacent to the rear panel such that the cover remains in its open position wherein the cover does not generally cover or seal the storage compartment.

In one embodiment, the filer further includes a pair of opposed accordion style side panels coupled to and extending between the front and rear panel, and wherein the side panels define the width of the storage compartment.

In one embodiment, a plurality of pockets are positioned within the storage compartment.

In one embodiment, the invention is a method for manipulating a filer including the step of accessing a filer including a front panel and rear panel defining a storage compartment therebetween, the storage compartment having a width. The filer further includes a cover coupled to the rear panel and releasably attachable to the front panel to generally cover or seal the storage compartment. At least a distal portion of the cover has a width that is about equal to or smaller than the width of the storage compartment. The method further includes inserting the distal portion of the front cover in the storage compartment such that the front cover is retained in an open position such that the front cover generally does not cover or seal the storage compartment.

The invention claimed is:

1. A filer comprising:

a front panel including an elastic cord retaining structure;

a rear panel;

a bottom panel extending between the front and rear panels;

a pair of side panels between the front and rear panels and defining a pocket between the front and rear panels, the pocket having a first width; and a cover attached to the rear panel and having a height less than a height of the rear panel, the cover comprising:

a proximal portion nearer the rear panel and having a second width;

a distal portion further from the rear panel and having a third width less than the second width, the distal portion including a distal edge having a concave contour corresponding with a convex portion of the elastic cord retaining structure;

a step-shaped notch formed at a junction of the proximal portion and the distal portion;

an elastic cord attached to at least one of the distal portion and the proximal portion, the elastic cord configured to be received around the elastic cord retaining structure on the front panel when the cover is in a closed position; and at least one flex area that is more flexible than at least one of the proximal and distal portions, the flex area configured to permit the cover to be moved between the closed position where the distal portion of the cover is at least partially superimposed over the front panel and an access position where the distal portion of the cover is at least partially received in the pocket and the proximal portion of the cover is inhibited from being received in the pocket.

2. The filer of claim 1, wherein the front panel, rear panel, bottom panel, and cover are made from a single piece of material.

3. The filer of claim 1, wherein the flex area comprises as least one transverse crease line in the cover.

4. The filer of claim 1, wherein the flex area comprises a material different from at least one of the proximal and distal portions.

5. The filer of claim 1, wherein the second width is greater than the first width, and the third width is less than the first width.

6. The filer of claim 1, wherein the flex area forms the cover so that the proximal and distal portions lie approximately parallel to at least one of the front panel and rear panel.

7. The filer of claim 1, wherein the side panels comprise an accordion-folded material having a plurality of folds, and wherein the distal portion of the cover is sized to be received between adjacent folds of the accordion-folded material on both of the side panels in an interference fit when the cover is in the access position such that the cover is frictionally engaged with the side panels to inhibit removal of the cover therefrom.

8. The filer of claim 1, wherein the front panel, rear panel, and cover comprise one or a combination of plastic, paper, paperboard, polyethylene, polypropylene, leather, cloth, and metal.

9. The filer of claim 1, wherein the flex area forms a bend or curve, the bend or curve having an included angle of approximately 180 degrees.

10. The filer of claim 1, further comprising a plurality of removable dividers positioned in the pocket.

11. A filer comprising:

a front panel;

a rear panel;

a bottom panel extending between the front and rear panels;

a pair of side panels comprising an accordion-folded material having a plurality of folds, the side panels extending between the front and rear panels and defining a pocket between the front and rear panels, the pocket having a first width; and a cover attached to the rear panel, the cover comprising:

a proximal portion having a second width;

a distal portion having a third width less than the second width, the distal portion of the cover sized to be received between adjacent folds of the accordion-folded material on both of the side panels when the cover is in an access position;

a step-shaped notch formed at a junction of the proximal portion and the distal portion; and at least one flex area that is more flexible than at least one of the proximal and distal portions, the flex area configured to permit the cover to be moved between the access position where the distal portion of the cover is received between the adjacent folds in an interference fit such that the cover is frictionally engaged with the side panels and the proximal portion of the cover is inhibited from being received in the pocket, and a closed position where the distal portion of the cover is at least partially superimposed over the front panel.

12. The filer of claim 11, wherein the front panel, rear panel, bottom panel, and cover are made from a single piece of material.

13. The filer of claim 11, wherein the flex area comprises as least one transverse crease line in the cover.

14. The filer of claim 11, wherein the flex area comprises a material different from at least one of the proximal and distal portions.

15. The filer of claim 11, wherein the second width is greater than the first width, and the third width is less than the first width.

16. The filer of claim 11, wherein the flex area forms the cover so that the proximal and distal portions lie approximately parallel to at least one of the front panel and rear panel.

17. The filer of claim 11, wherein the front panel, rear panel, and cover comprise one or a combination of plastic, paper, paperboard, polyethylene, polypropylene, leather, cloth, and metal.

18. The filer of claim 11, wherein the flex area forms a bend or curve, the bend or curve having an included angle of approximately 180 degrees.

19. The filer of claim 11, further comprising a plurality of dividers positioned in the pocket.

* * * * *